United States Patent [19]

Matzke

[11] 3,968,738

[45] July 13, 1976

[54] PLASTIC LOUVER FRAME ASSEMBLY

[75] Inventor: William A. Matzke, Mahopac, N.Y.

[73] Assignee: Champion International Corporation, Stamford, Conn.

[22] Filed: Apr. 24, 1975

[21] Appl. No.: 571,060

Related U.S. Application Data

[63] Continuation of Ser. No. 464,915, April 29, 1974, abandoned.

[52] U.S. Cl. ..... 98/108; 52/473; 98/114; 98/121 R

[51] Int. Cl.[2] ..... F24F 13/06

[58] Field of Search ..... 98/101, 110, 114, 121 R, 98/103, 108; 52/473

[56] References Cited

UNITED STATES PATENTS

| | | | |
|---|---|---|---|
| 2,210,516 | 8/1940 | Wheeler | 98/121 R |
| 2,962,956 | 12/1960 | Magyar | 98/121 R |
| 2,998,765 | 9/1961 | Spargo | 98/110 |
| 3,217,631 | 11/1965 | Thomason et al. | 98/121 R |
| 3,580,160 | 5/1971 | McCabe | 98/121 R |
| 3,653,317 | 4/1972 | Costanzo, Jr. | 98/110 |

*Primary Examiner*—William F. O'Dea
*Assistant Examiner*—Ronald C. Capossela
*Attorney, Agent, or Firm*—Anthony J. Casella

[57] ABSTRACT

An assembly of plastic louver strips secured by two vertical frames having cut out portions into which the louver strips extend. Louver strips which are flexible can be snapped into place after the frame is in place. Flexible strips can also be removed for cleaning. The vertical frames are slidably assembled into basic frame members and when in place form a space into which the ends of the louvers are positioned.

3 Claims, 6 Drawing Figures

PLASTIC LOUVER FRAME ASSEMBLY

This is a continuation of application Ser. No. 464,915 filed Apr. 29, 1974 now abandoned.

BACKGROUND OF THE INVENTION

Louvers are old in the building art and are considered an important part of any structure where ventilation is necessary. Louvers and their frames have generally been built of wood although a few installations have used louvers made of thin metal such as steel and aluminum. All the prior louver assemblies have been difficult to manufacture and have been expensive. In addition, those made of steel and wood require constant maintenance since they must be painted periodically.

While the louver assembly described herein can be made of metal, the preferred material is plastic, especially the louver strips. Plastic strips need no paint, they can be made in many colors, and do not rot, even when subjected to rain, humid weather, and hot ambient atmosphere.

One of the features of the present invention is the ease of manufacture of all components. Only three types of strips are required and each may be extruded in long lengths and then cut to the desired length at the assembly point for final fitting.

Another feature of the invention is the ability to snap in the louver strips into the retaining channels. They may also be removed easily for cleaning.

Still another feature is the various cross sectional configurations which may be imparted to the louver strips.

SUMMARY

The invention comprises a plastic louver frame assembly comprising an external frame of four sides for fitting into a hole in a wall, partition or door structure. The external frame includes two inwardly extending turned over rails which form slots. Two vertical placed retaining frames, each formed with outwardly extending slide members, are secured to the external frames by sliding the slide members into the slots in the frame. Each retaining frame is formed with a series of spaced angular slots and a series of plastic louver strips fit into the angular slots to complete the louver assembly.

When flexible louver strips are used the external and retaining frames can be assembled first and then the louver strips snapped into place.

Additional details of the invention will be disclosed in the following description, taken in connection with the accompanying drawings.

DESCRIPTION OF THE PREFERRED EMBODIMENT

Figure 1:
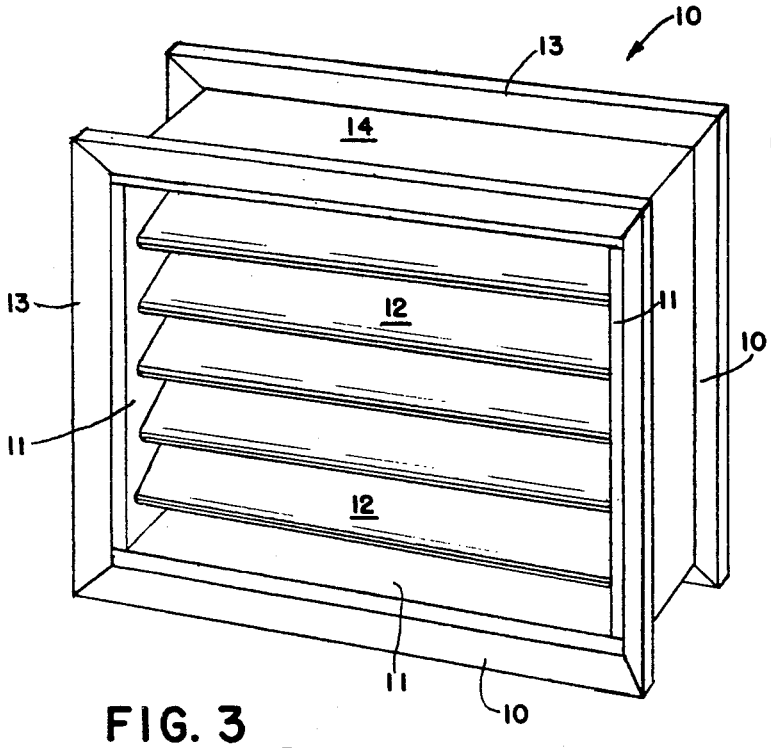
FIG. 1 is a perspective view of the assembled louver.
Figure 2:
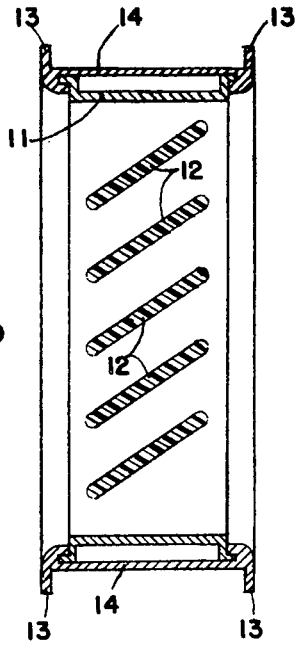
FIG. 2 is a cross sectional view of the louver shown in FIG. 1 taken along a median vertical plane.
Figure 3:
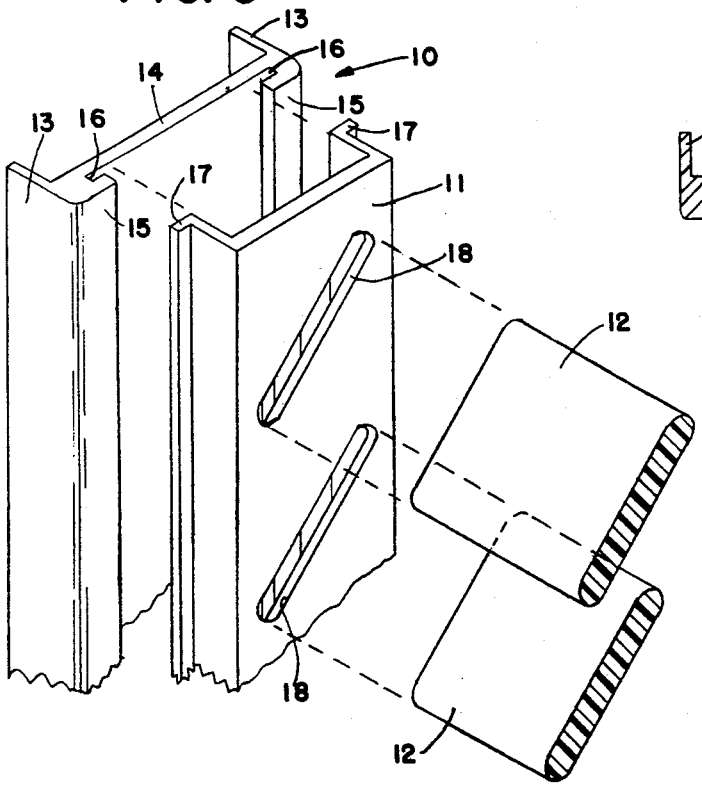
FIG. 3 is an exploded view of a portion of the louver.
Figure 4:
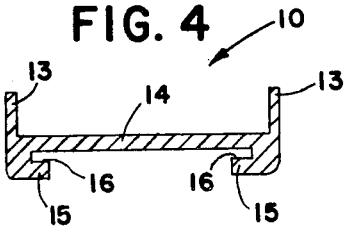
FIG. 4 is a cross sectional view of one of the external frames.
Figure 5:
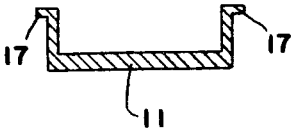
FIG. 5 is a cross sectional view of one of the retaining frames.

Referring now to the figures, the assembled louver comprises an external frame 10, an inner retaining frame 11, and a plurality of louver strips 12. The external frame 10 is made up of four similar pieces each having two flanges 13 for fitting over a stud or other portion of a wall which supports the louver. The external frame 10 also includes a flat web 14 and two inwardly extending rails 15 which define a slot 16. As shown in FIG. 2, the retaining frame 11 is formed with two outwardly extending slide members 17 which fit into slot 16 and form a permanent lock to hold the two frames together.

The retaining frame is formed with a series of spaced elongated openings 18 having the same shape as a section of a louver strip 12. The shape of the retaining frame 11 produces a space between it and the web 14 so that the louver strips 12 can be accomodated easily with some tolerance of length. A frame, similar to the retaining frame but without openings, can be used as a sill at the bottom of the louver and also at the top.

Figure 6:
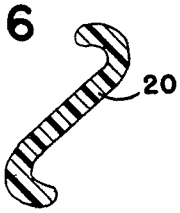
FIG. 6 is a cross sectional view of an alternate form of louver strip.

FIG. 6 shows an alternate form of louver strip 20 having a section in the form of an S. This strip 20 and other non-flat strips are fitted into corresponding shaped holes in the retaining frames. A variety of shapes can be employed, such as oval, curved, and I-shaped, depending upon the results desired by the louver assembly. The louver strips may also be hollow.

When the louver assembly is put into operation, the base element of the external frame, together with a sill, is put into place in a wall. Next, the side elements of the external frame are put in place and fastened. If the louver strips are too stiff to be bent easily, the two vertical retaining frames 11 are assembled with all the louver strips and the entire array is dropped into the external frames, the slide members 17 meshing with the slots 16 under the rails 15. Then the top frames 11 and 14 are placed in position and the assembly is complete.

If the louver strips 12 are flexible, the entire framework can be assembled and the strips 12 snapped into opening 18 afterward.

Accordingly, the present invention provides a new and improved plastic louver frame assembly which may be readily incorporated in a door or wall structure of a building to provide desired ventilation. While several preferred embodiments have been described, it will be understood that various modifications, alternatives and equivalents are to be included within the scope of the invention. For instance, other forms of arcuate cross sections of the strip 20 may be embodied in the frame assembly, and the plastic strips 20 may be made of any suitable plastic material such as polyvinyl chloride, polyethylene, polypropylene, polystyrene, and acrylonitrile butadiene styrene.

The embodiments of the invention in which an exclusive property or privilege is claimed are defined as follows:

1. A plastic louver frame assembly comprising: an external frame assembly comprising top, bottom, and side external frame sections for fitting into an opening in a wall, including two inwardly extending turned-over rails forming vertical grooves in the side external frame sections; two vertical retaining frames, each formed with outwardly extending members which are slidably received into the grooves in the side external frame sections and are formed with a U-shaped channel defining an enclosed air space, each retaining frame formed with angular slots closed at each end; and a series of plastic louver strips positioned in the angular slots in the retaining frames, and held against movement by the slot ends.

2. A frame assembly according to claim 1 wherein the top and bottom external frame sections are provided with a covering frame, similar to the vertical retaining frames but having a solid surface.

3. A frame assembly according to claim 1 wherein each of the external frame sections including flanges, slots, and rails are formed of a single piece of material.

* * * * *